US009428975B2

(12) United States Patent
Stave et al.

(10) Patent No.: US 9,428,975 B2
(45) Date of Patent: Aug. 30, 2016

(54) DRILLING FLUID PUMP MODULE COUPLED TO SPECIALLY CONFIGURED RISER SEGMENT AND METHOD FOR COUPLING THE PUMP MODULE TO THE RISER

(75) Inventors: Roger Sverre Stave, Straume (NO); Kjell Rune Toftevåg, Knarrevik (NO); Inge Fadnes, Bergen (NO); Arvid Iversen, Nesttun (NO)

(73) Assignee: ENHANCED DRILLING A.S., Straume (NO)

( * ) Notice: Subject to any disclaimer, the term of this patent is extended or adjusted under 35 U.S.C. 154(b) by 334 days.

(21) Appl. No.: 14/239,172

(22) PCT Filed: Aug. 17, 2012

(86) PCT No.: PCT/IB2012/001906

§ 371 (c)(1),
(2), (4) Date: Mar. 18, 2014

(87) PCT Pub. No.: WO2013/024354

PCT Pub. Date: Feb. 21, 2013

(65) Prior Publication Data

US 2014/0193282 A1 Jul. 10, 2014

Related U.S. Application Data

(60) Provisional application No. 61/524,798, filed on Aug. 18, 2011.

(51) Int. Cl.

| | |
|---|---|
| ***E21B 17/01*** | (2006.01) |
| ***E21B 21/08*** | (2006.01) |
| ***E21B 21/00*** | (2006.01) |

(52) U.S. Cl.

CPC ..... *E21B 21/08* (2013.01); *E21B 17/01* (2013.01); *E21B 21/001* (2013.01); *Y10T 29/49826* (2015.01)

(58) Field of Classification Search

CPC ..... E21B 17/01; E21B 21/001; E21B 21/08
USPC ..... 166/358
See application file for complete search history.

(56) References Cited

U.S. PATENT DOCUMENTS 4,063,602 A * 12/1977 Howell ..... E21B 7/128 175/48
4,291,772 A * 9/1981 Beynet ..... E21B 21/08 175/25
6,102,673 A * 8/2000 Mott ..... E21B 21/001 137/596.17

(Continued)

FOREIGN PATENT DOCUMENTS

GB 2365044 A 2/2002
WO WO 2006054905 A1 * 5/2006 ..... E21B 21/08

OTHER PUBLICATIONS

Notification of Transmittal of the International Search Report and the Written Opinion of the International Searching Authority, or the Declaration, PCT/IB2012/001906, Feb. 5, 2014.

*Primary Examiner* — Matthew R Buck
(74) *Attorney, Agent, or Firm* — Richard A. Fagin; Adenike Adebiyi

(57) ABSTRACT

A pump module for a drilling riser includes at least one pump mounted to a frame, the frame including features to couple the frame to a segment of riser. A fluid inlet is affixed to the frame. The fluid inlet is in fluid communication with an intake of the at least one pump. The fluid inlet has features to make fluid tight hydraulic connection to a fluid outlet of the riser segment when the frame is coupled thereto.

14 Claims, 12 Drawing Sheets

(56) References Cited

U.S. PATENT DOCUMENTS 6,454,022 B1 * 9/2002 Sangesland ..... E21B 21/08 175/5
6,966,367 B2 * 11/2005 Butler ..... E21B 21/001 166/105
7,270,185 B2 * 9/2007 Fontana ..... E21B 7/12 166/347
7,690,135 B2 * 4/2010 Yu ..... E02F 3/8858 37/309
7,913,764 B2 * 3/2011 Smith ..... E21B 21/001 166/345
8,573,307 B2 * 11/2013 Moksvold ..... E21B 17/01 166/345
2003/0066650 A1 * 4/2003 Fontana ..... E21B 7/12 166/358
2010/0147528 A1 * 6/2010 Baugh ..... E21B 19/24 166/355
2011/0101682 A1 * 5/2011 Vatne ..... E21B 17/01 285/308

* cited by examiner

DRILLING FLUID PUMP MODULE COUPLED TO SPECIALLY CONFIGURED RISER SEGMENT AND METHOD FOR COUPLING THE PUMP MODULE TO THE RISER

BACKGROUND

The disclosure relates generally to the field of wellbore drilling using a pump to lift drilling fluid out of the wellbore so as to maintain a selected wellbore pressure. More specifically, the disclosure relates to mud return pumps and methods for connecting such pumps to a drilling riser.

FIG. 1 shows an example "mud lift" drilling system using a drilling fluid ("mud") return pump when drilling from a platform (drilling unit) at the water surface. Typically, a conductor is first driven into the water bottom in marine drilling operations. When drilling a borehole 15 from the drilling device, drilling fluid is pumped through a drill string 16 down to a drilling tool, usually including a drill bit (not shown). The drilling fluid serves several purposes, one of which is to transport drill cuttings out of the borehole. Efficient transport of drill cuttings is conditioned on the drilling fluid being relatively viscous. The drilling fluid flows back through an annulus 30 between the borehole wall, a liner 14, which is typically coupled to a riser 12 at a wellhead (not shown) proximate the water bottom and the drill string 16, and up to the drilling unit, where the drilling fluid is treated and conditioned before being pumped back down to the borehole. In many cases, this will result in a head of pressure that is undesirable.

By coupling a pump 20 to the liner 14 near the water bottom or to a drilling riser 12 at a selected level above the water bottom the returning drilling fluid can be pumped out of the annulus 30 and up to the drilling rig. The annular volume in the riser 12 above the drilling fluid may be filled with a riser fluid. Preferably, the density of the riser fluid is less than that of the drilling fluid.

The drilling fluid pressure at the water bottom may be controlled from the drilling unit by selecting the inlet pressure to the pump 20. The height $H_1$ of the column of drilling fluid above the water bottom depends on the selected inlet pressure of the pump, the density of the drilling fluid and the density of the riser fluid, as the inlet pressure of the pump is equal to: $P=H1\gamma b+H_2\gamma s$, wherein $\gamma b$=the density of the drilling fluid, $H_2$=the height of the column of riser fluid, and $\gamma s$=the density of the riser fluid.

In order to prevent the drilling fluid pressure from exceeding an acceptable level (e.g. in the case of a pipe trip), the riser may be provided with a dump valve. A dump valve of this type can be set to open at a particular pressure for outflow of drilling fluid to the sea.

The following describes a non-limiting example of a method and device illustrated in the accompanying drawings, in which, as noted above, FIG. 1 is a schematic view of a fixed drilling rig provided with a pump for the returning drilling fluid, the pump being coupled to the riser section near the seabed and the riser section being filled with a fluid of a different density than that of the drilling fluid.

Reference number 1 denotes a drilling unit comprising a support structure 2, a deck 4 and a derrick 6. The support structure 2 is placed on the water bottom 8 (or the support structure may be affixed to flotation devices as is well known in the art) and projects above the surface 10 of the water. The riser section 12 of the liner 14 extends from the water bottom 8 up to the deck 4, while the liner 14 runs further down into a borehole 15. The riser section 12 is provided with required well head valves (not shown).

The drill string 16 projects from the deck 4 and down through the liner 14. A first pump pipe 17 is coupled to the riser section 12 near the water bottom 8 via a valve 18 and the opposite end portion of the pump pipe 17 is coupled to a pump 20 placed near the seabed 8. A second pump pipe 22 runs from the pump 20 up to a collection tank 24 for drilling fluid on the deck 4.

A tank 26 for a riser fluid communicates with the riser section 12 via a connecting pipe 28 at the deck 4. The connecting pipe 28 has a volume meter (not shown). Preferably, the density of the riser fluid is less than that of the drilling fluid.

The power supply to the pump 20 may be via an electrical or hydraulic cable (not shown) from the drilling unit 1. The pressure at the inlet to the pump 20 is selected from the drilling unit 1. The pump 20 may be electrically driven, or may be driven hydraulically by means of oil that is circulated back to the drilling unit or by means of water that is dumped in the sea from the pump power outlet.

The drilling fluid is pumped down through the drill string 16 in a manner that is known in the art, returning to the deck 4 via an annulus 30 between the liner 14 and the drill string 16. When the pump 20 is started, the drilling fluid is returned from the annulus 30 via the pump 20 to the collection tank 24 on the deck 4. Using such a system it is possible to achieve, for example a significant reduction in the pressure of the drilling fluid in the borehole 15.

A particular issue with such systems is possibility of collapse of the first pump pipe 17 as a result of differential pressure between the hydrostatic pressure of the water at the depth of the pump pipe 17 and the internal pressure of the first pump pipe, depending on the pressure desired to be maintained in the wellbore. This is particularly an issue when the first pump pipe is made of flexible material, such as rubber hose. Such flexible materials are used so that the location of the pump 20 may be moved to suit the particular conditions in the water or proximate the water bottom 8.

What is needed is a pump system that excludes the use of a lengthy first pump pipe between the riser outlet and the pump inlet.

SUMMARY

One aspect of the invention is a pump module for a drilling riser. A pump module according to this aspect of the invention includes at least one pump mounted to a structure. The structure includes features to couple the it to a segment of a riser. A fluid inlet is affixed to the pump module. The fluid inlet is in fluid communication with an intake of the at least one pump. The fluid inlet has features to make fluid tight hydraulic connection to a fluid outlet of the riser segment when the frame is coupled thereto.

Other aspects and advantages of the invention will be apparent from the description and claims which follow.

DETAILED DESCRIPTION

Figure 1:
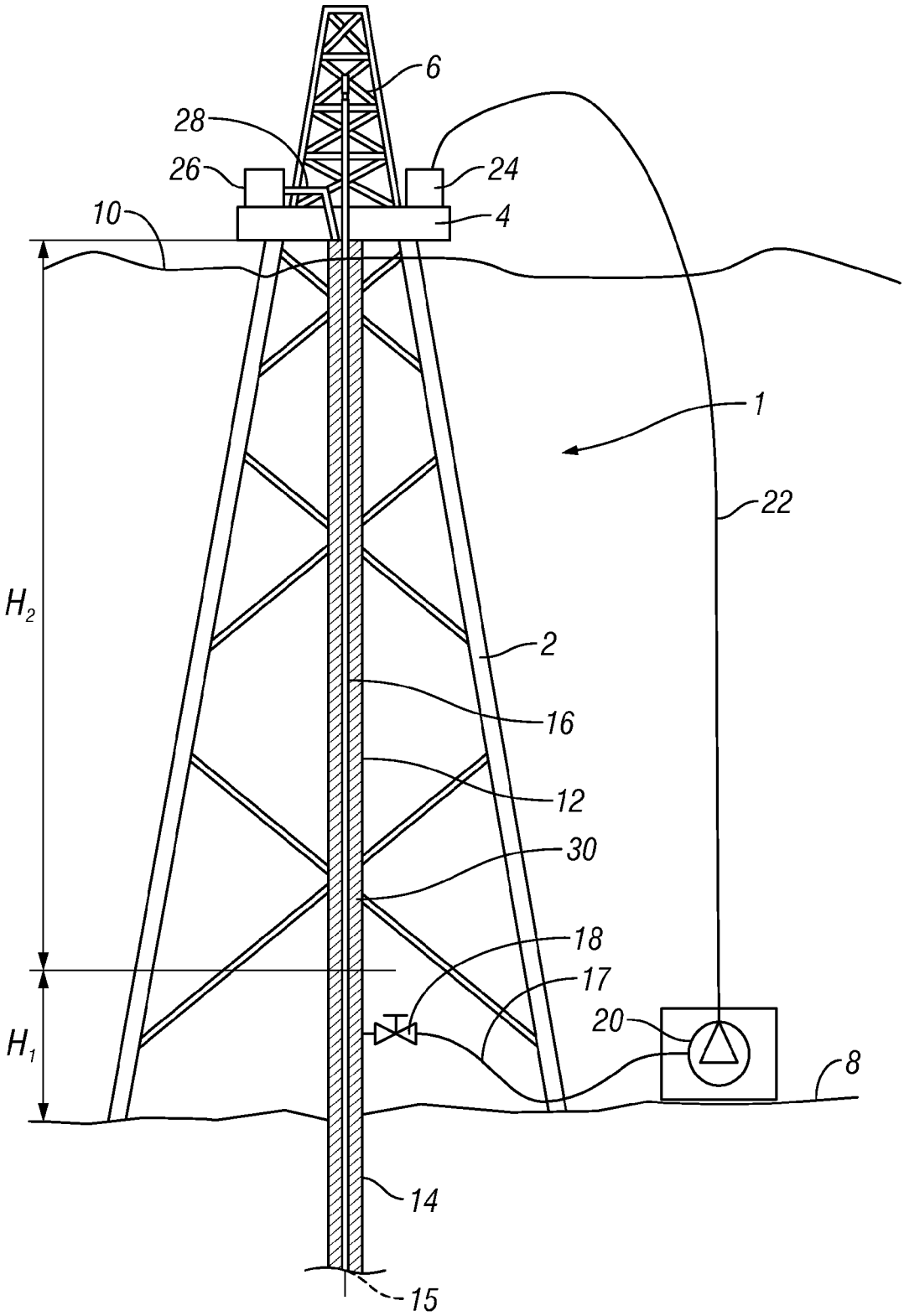
FIG. 1 (Prior Art)
FIG. 1 shows an example wellbore drilling system using a pump to lift fluid from the wellbore annulus so as to maintain a selected pressure in the wellbore.
Figure 2:
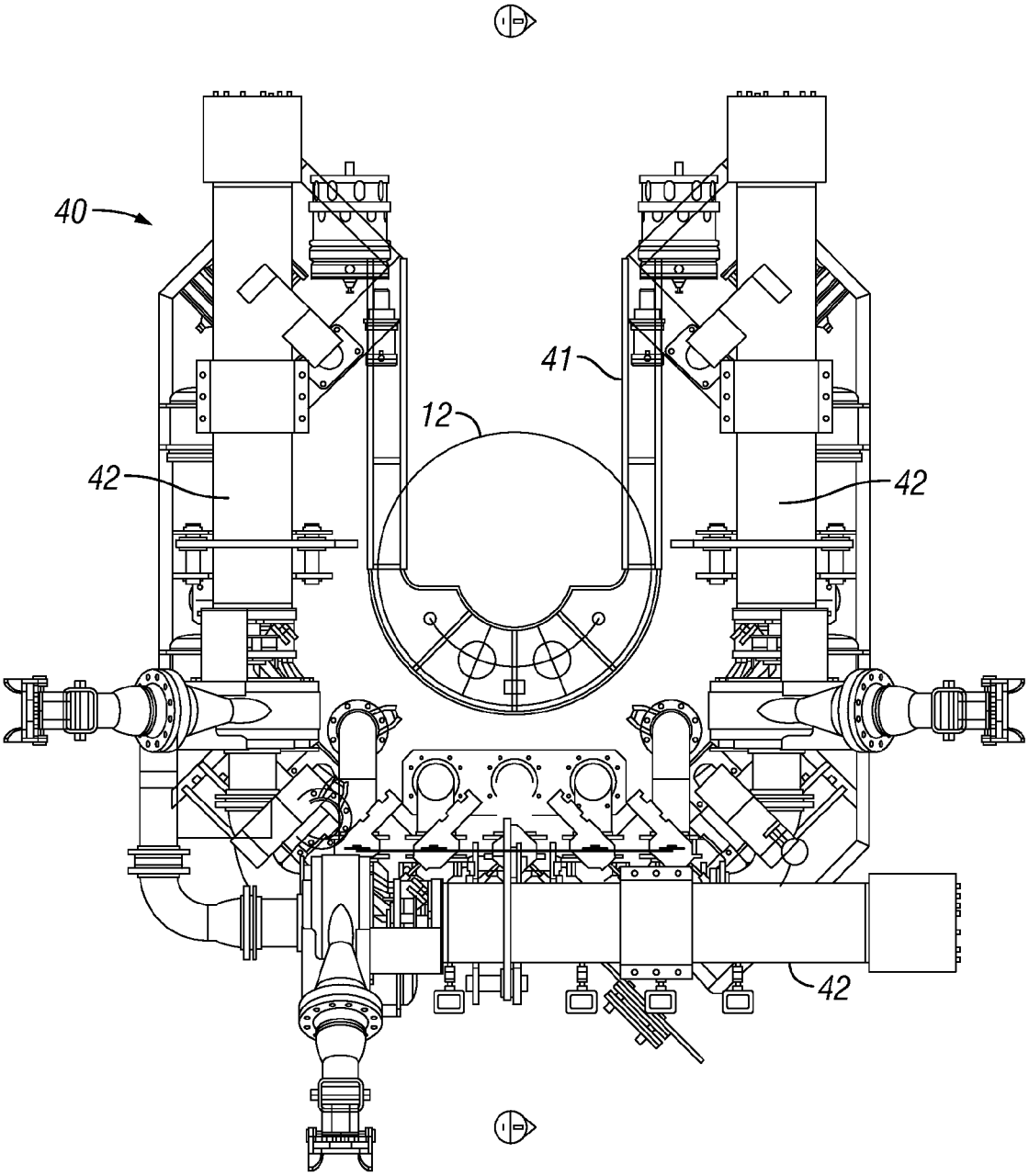
FIG. 2 shows an example of a horizontally oriented pump module in plan view.
Figure 3:
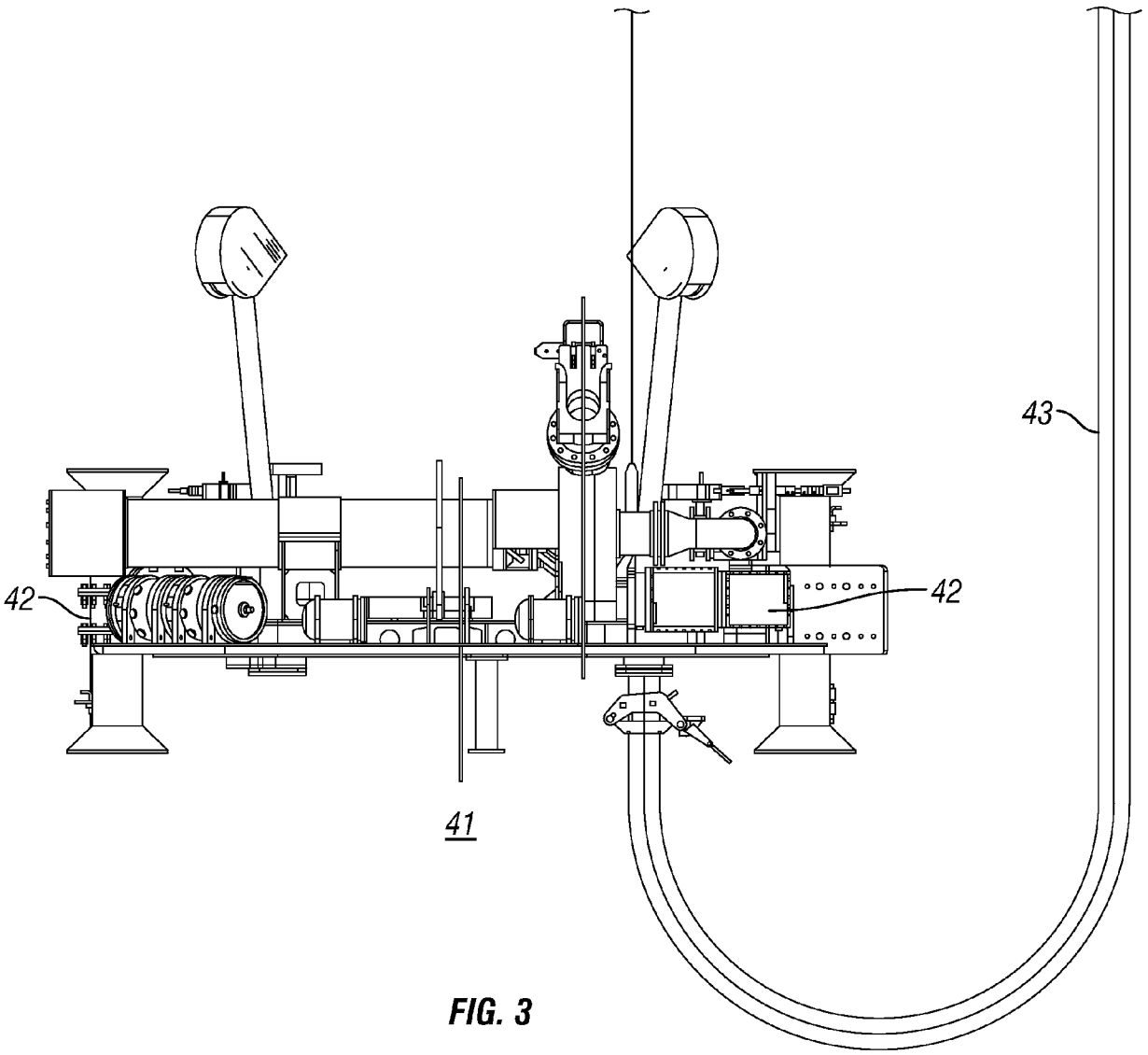
FIG. 3 shows the example module of FIG. 2 in side view with a mud return line.

FIG. 2 shows one example of a pump module 40 that can be used with a drilling system such as shown in FIG. 1. The pump module 40 may be assembled to the riser (12 in FIG. 1) below the drilling platform (4 in FIG. 1), either in the body of water or in the "moon pool" of a floating drilling platform to a specific riser segment (explained below) that has features for mating the pump module 40 both hydraulically and mechanically thereto. The pump module 40 may have one or more (three shown in FIG. 2) pumps 42 that are in fluid communication on an inlet side thereof with a fluid outlet (see FIG. 8) disposed in or forming part of the specific riser segment. An outlet of the pumps is shown in FIG. 3 at 43 and returns drilling fluid to the drilling unit (FIG. 1). An outlet of the pumps may in other examples be connected to one or more of the auxiliary lines associated with the riser, e.g., lines shown at 12A and 12B in FIG. 7. Such connection would require minor reconfiguration of the pump outlet (43 in FIG. 3) to conform to a lower end coupling of the auxiliary line(s) on the riser joint immediately above the pump module 40. The pumps 42 may be mounted on a platform or plate structure 41 that may include a semicircular opening on one side (FIG. 3) to enable engagement with a mating feature (not shown) on the specific riser segment (described below). Features such as an externally mounted ring (not shown) may be provided on the specific riser segment to hold the structure 41 in a selected axial position along the riser segment. A possible advantage of the configuration of the pump module 40 shown in FIGS. 2 and 3 is that its weight may be more evenly circumferentially distributed around the riser (12 in FIG. 1) thus reducing lateral stresses on the riser (12 in FIG. 1).

Figure 4:
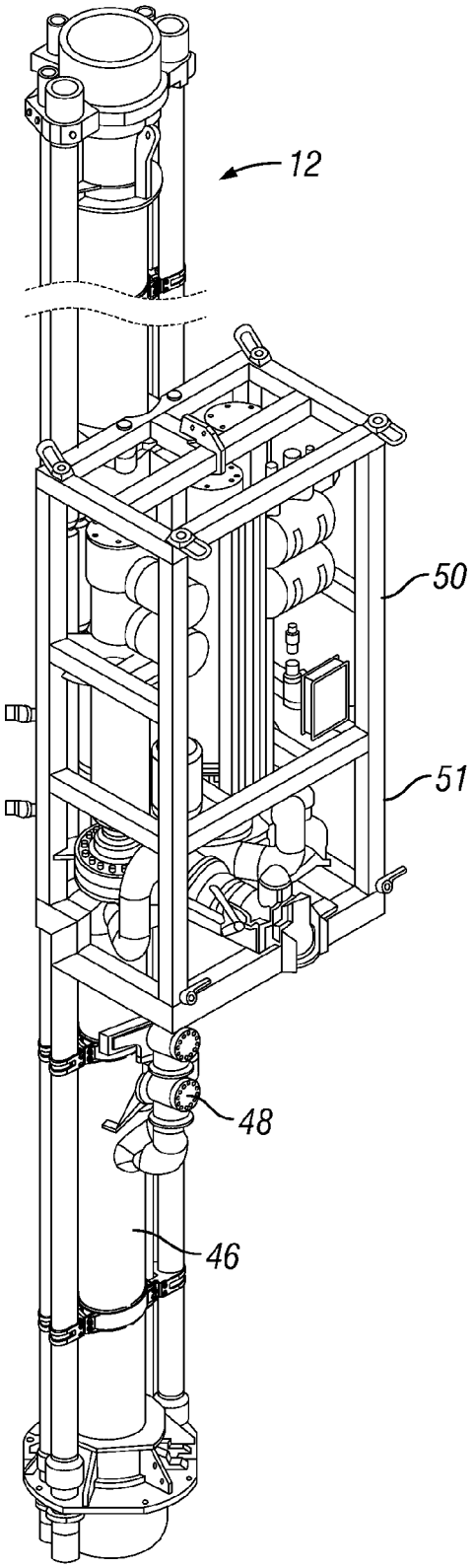
FIG. 4 shows an example vertically oriented pump module in side view docked to the riser, which special riser joint having a fluid outlet line.
Figure 5:
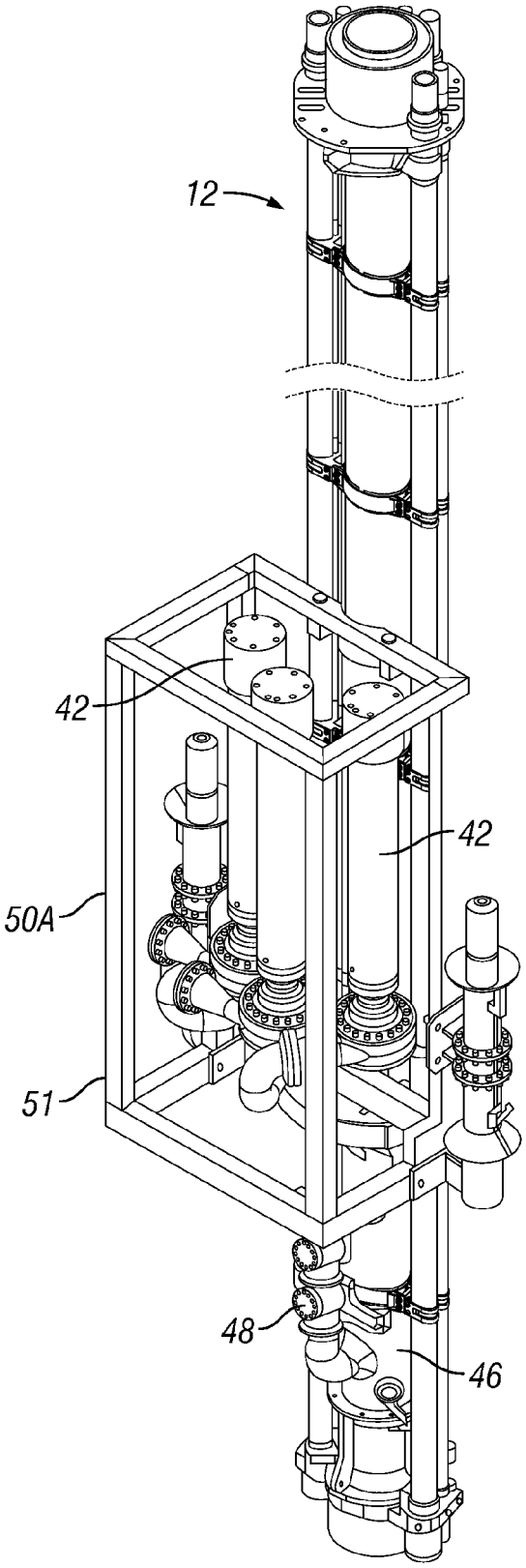
FIG. 5 shows another example vertically oriented pump module.

FIGS. 4 and 5 show two different examples of a vertically mounted pump module, 50 and 50A, respectively, each coupled to the specific segment 46 of the riser 12. The respective pump modules 50, 50A each may include one or more pumps, shown at 42 in FIG. 5, mounted in a structure 51. The structure 51 may be generally in the shape of an open rectangular box and which may include features (described below) to couple the structure 51 to the riser segment 46, and to make hydraulic connection between the pump(s) 42 fluid inlet and a riser fluid outlet. Below each pump module 50, 50A the specific riser segment 46 may include a riser fluid outlet 48 in the form of a pipe that exits the riser segment 46 laterally and may turn vertically to couple to the pump(s) fluid inlet when the frame 51 is coupled to the riser segment 46. The fluid outlet 48 may be a metal forging having the capacity to withstand high external differential pressure (e.g., in excess of 600 psi) without crushing. As will be further explained, an upper end of the riser fluid outlet 48 may include a feature to enable easy connection of the pump module pump inlet (FIG. 11) to the upper end of the fluid outlet 48.

Figure 6:
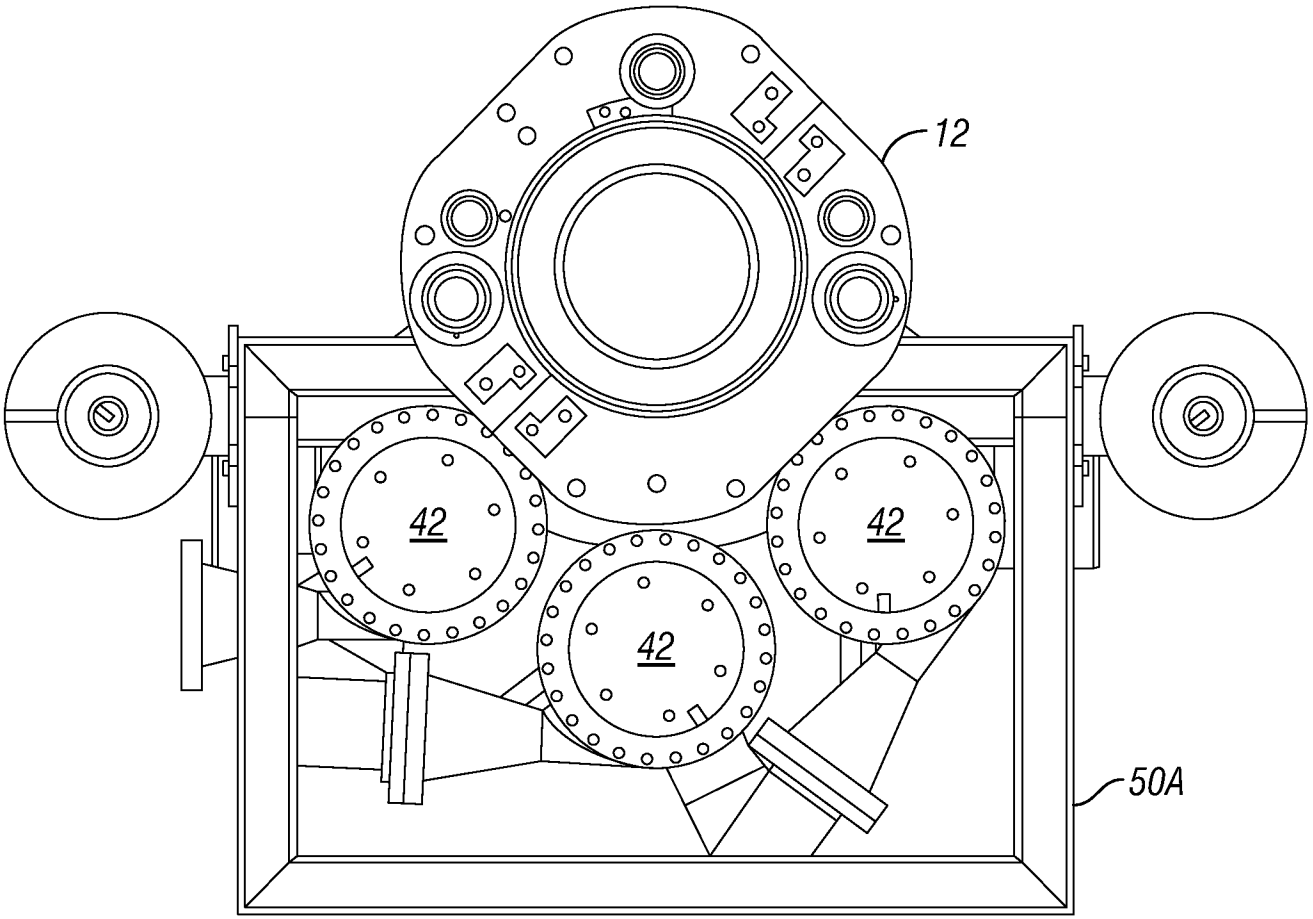
FIG. 6 shows the module of FIG. 5 in plan view.

FIG. 6 shows a plan view of the pump module 50A of FIG. 5 from above coupled to one side of the riser 12, and showing three pumps 42, although the number of such pumps in any example module is not intended to limit the scope of the disclosure. A possible advantage of using the vertical configuration shown in FIGS. 4 through 6 is that such a pump module (either 50 in FIG. 4 or 50A in FIG. 5) may be mounted to the specific riser segment (called a "joint" 46 in FIGS. 4 and 5) using a modified blowout preventer (BOP) cart disposed under the platform (4 in FIG. 1), but still above the water surface, i.e., within the confines of the drilling unit (1 in FIG. 1). An example of such configuration will be explained below with reference to FIGS. 13 and 14.

Figure 7:
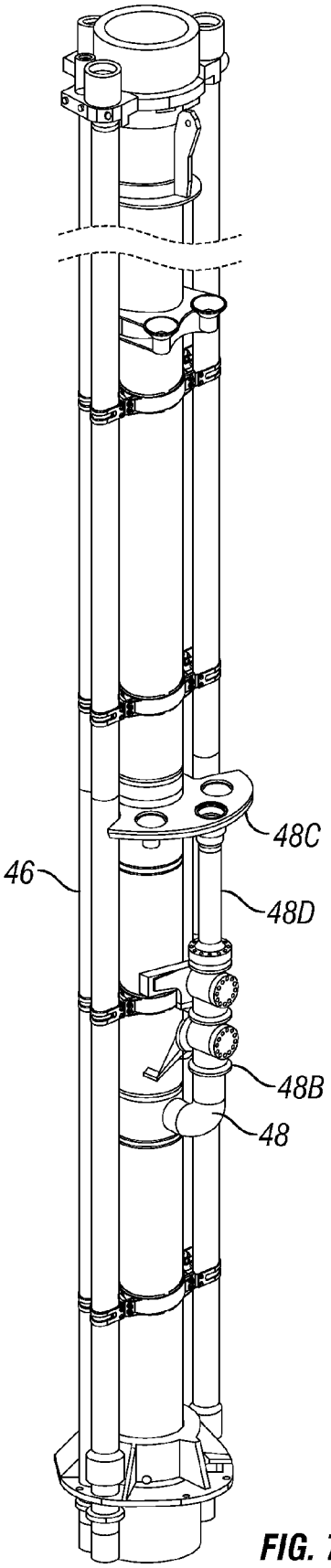
FIG. 7 shows the special riser joint of FIG. 5 in more detail and shows a pump module landing structure.
Figure 8:
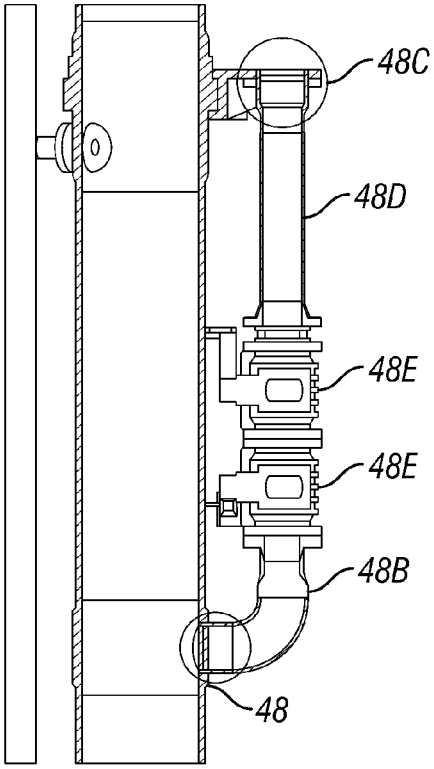
FIG. 8 shows details of the special riser joint and module landing structure.
Figure 9:
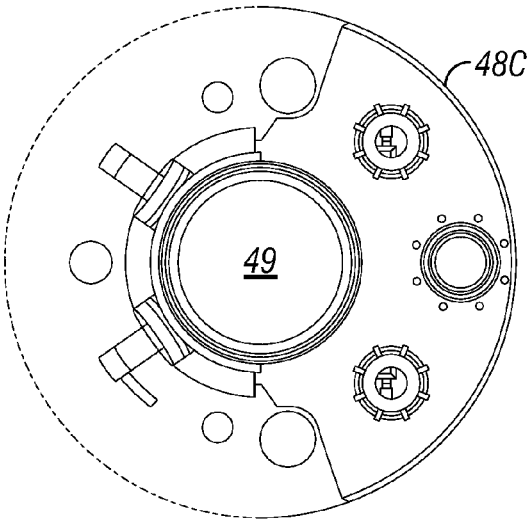
FIG. 9 shows a plan view of the landing structure.

FIG. 7 shows the riser segment 46 in more detail, including the fluid outlet 48, the previously described pipe 48B, which may be a forged component, optional control valves 48E and a spool piece 48D leading from the control valves 48E to a docking structure 48C coupled to the riser segment 48. The foregoing components are shown in more detail in FIG. 8. A plan view of the docking structure 48C is shown in FIG. 9.

The modified riser segment including outlet 48 and docking structure 48C may be configured such that it will pass through the rotary table of the drilling unit.

Figure 10:
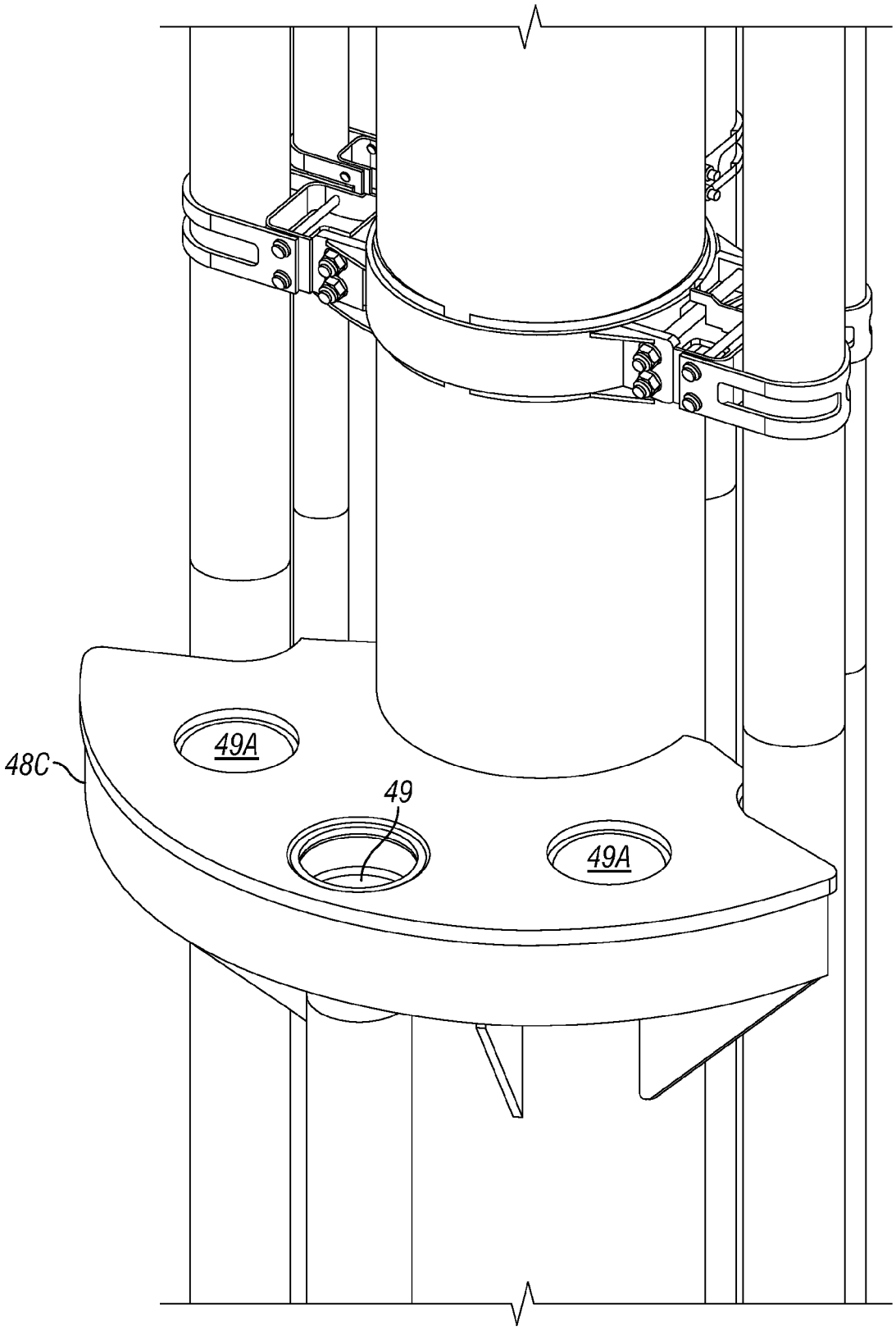
FIG. 10 shows an oblique view of the landing structure.

An enlarged view of the docking structure 48C is shown in FIG. 10. The opening to the spool piece (48D in FIG. 8) is shown at 49, and mates with a corresponding device coupled hydraulically to the intake of the pumps (42 in FIG. 6). Receptacles 49A are provided for guide and locking pins to be received to engage the pump module (e.g., 50 in FIG. 4) to the docking structure 48C.

Figure 11:
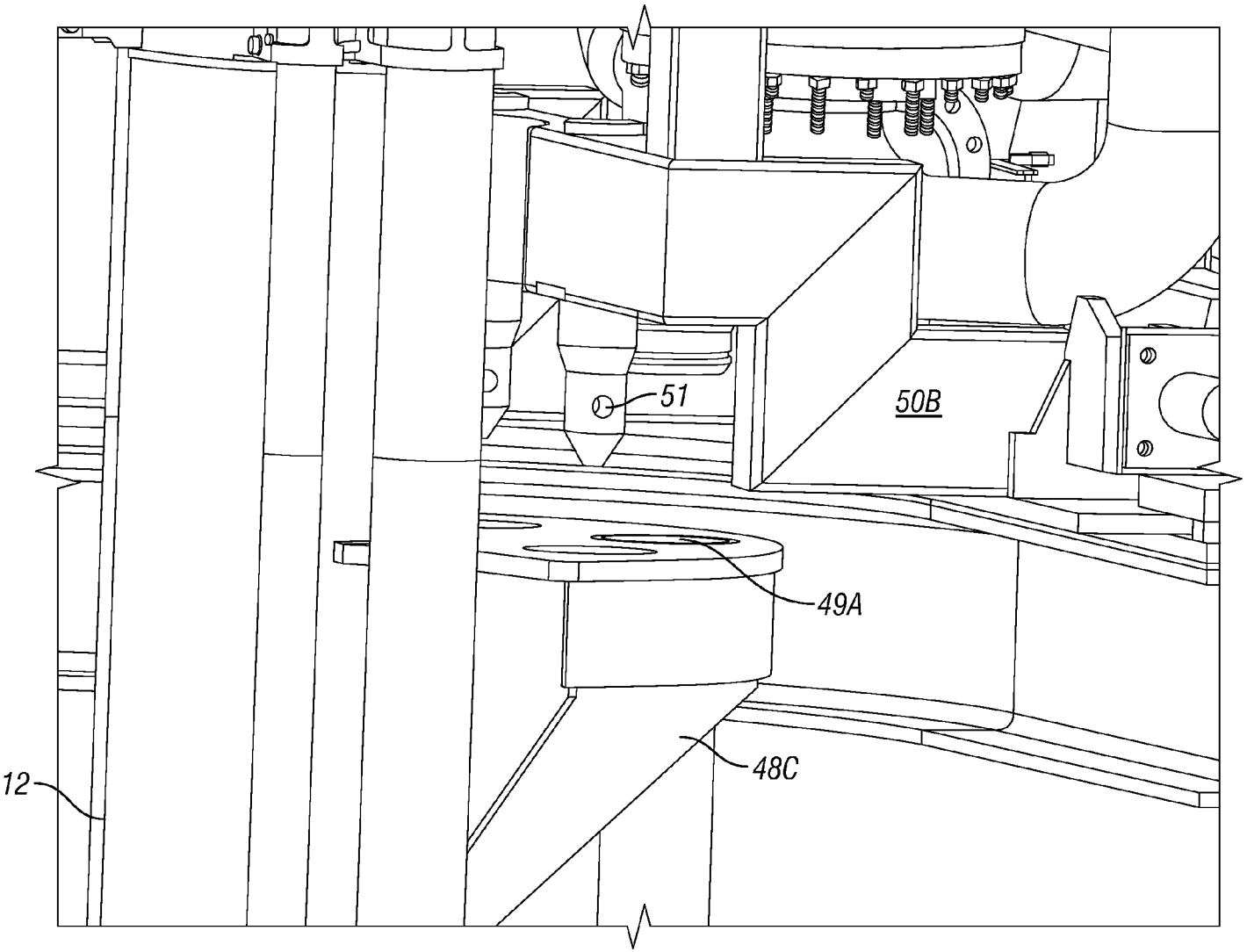
FIG. 11 shows locking pins that mount the pump module to the landing structure.

An enlarged view of one of the guide and locking pins 51 approaching the corresponding receptacle 49 in the docking structure 48C is shown in FIG. 11. The pins 51 may form part of or be affixed to the pump module frame 50B.

Figure 12:
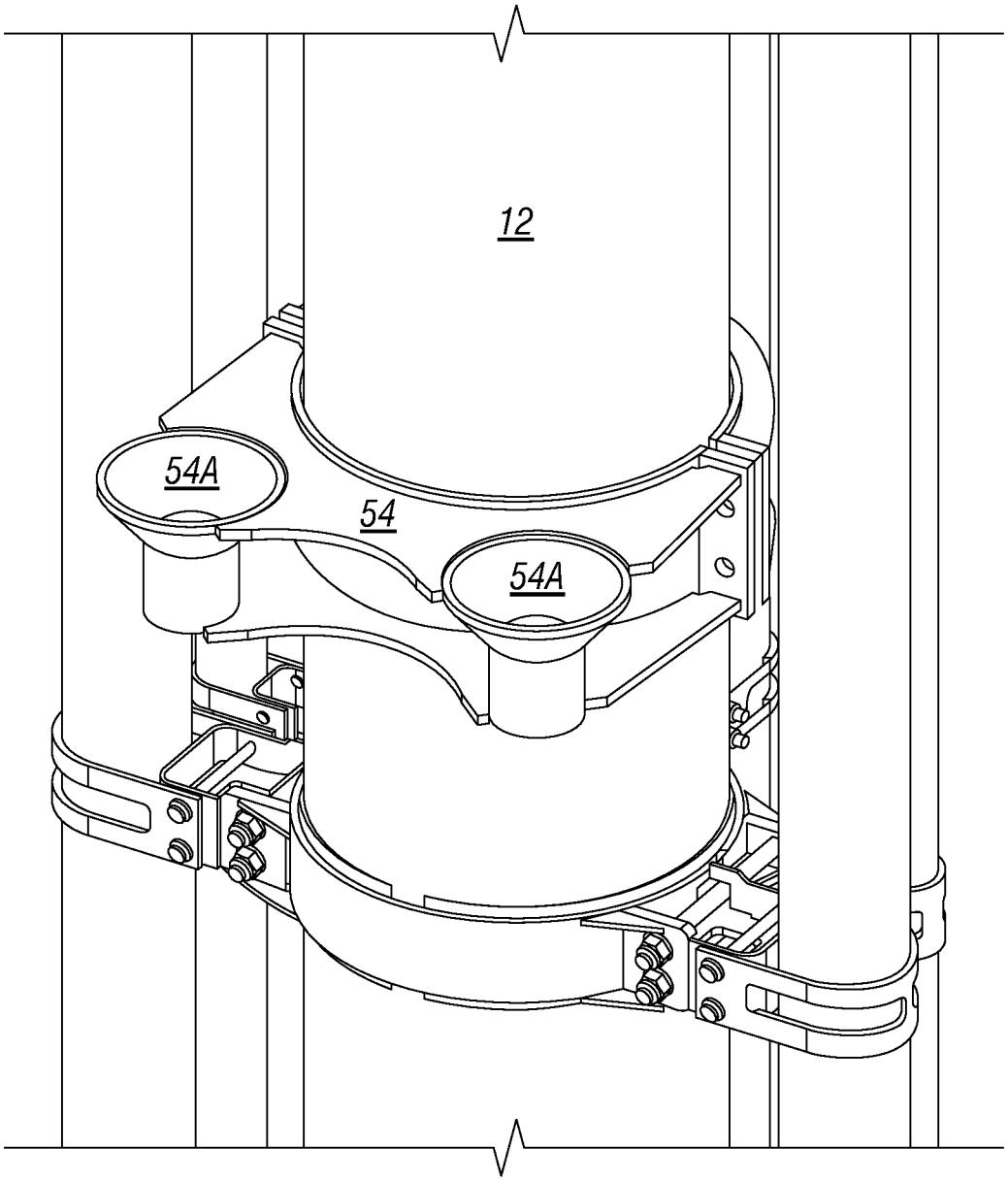
FIG. 12 shows an upper pump module retaining structure.

Finally, in FIG. 12, an upper pump module frame support 54 is shown clamped to the riser 12. The upper support 54 may be affixed to the riser 12 after the pump module (50 in FIG. 4) is received in the docking structure (48C in FIG. 11) and moved so that it is effectively parallel to the riser 12. Corresponding pins (not shown) on the upper end of the pump module frame (50B in FIG. 11) may mate with openings 54A in the upper frame support 54.

Figure 13:
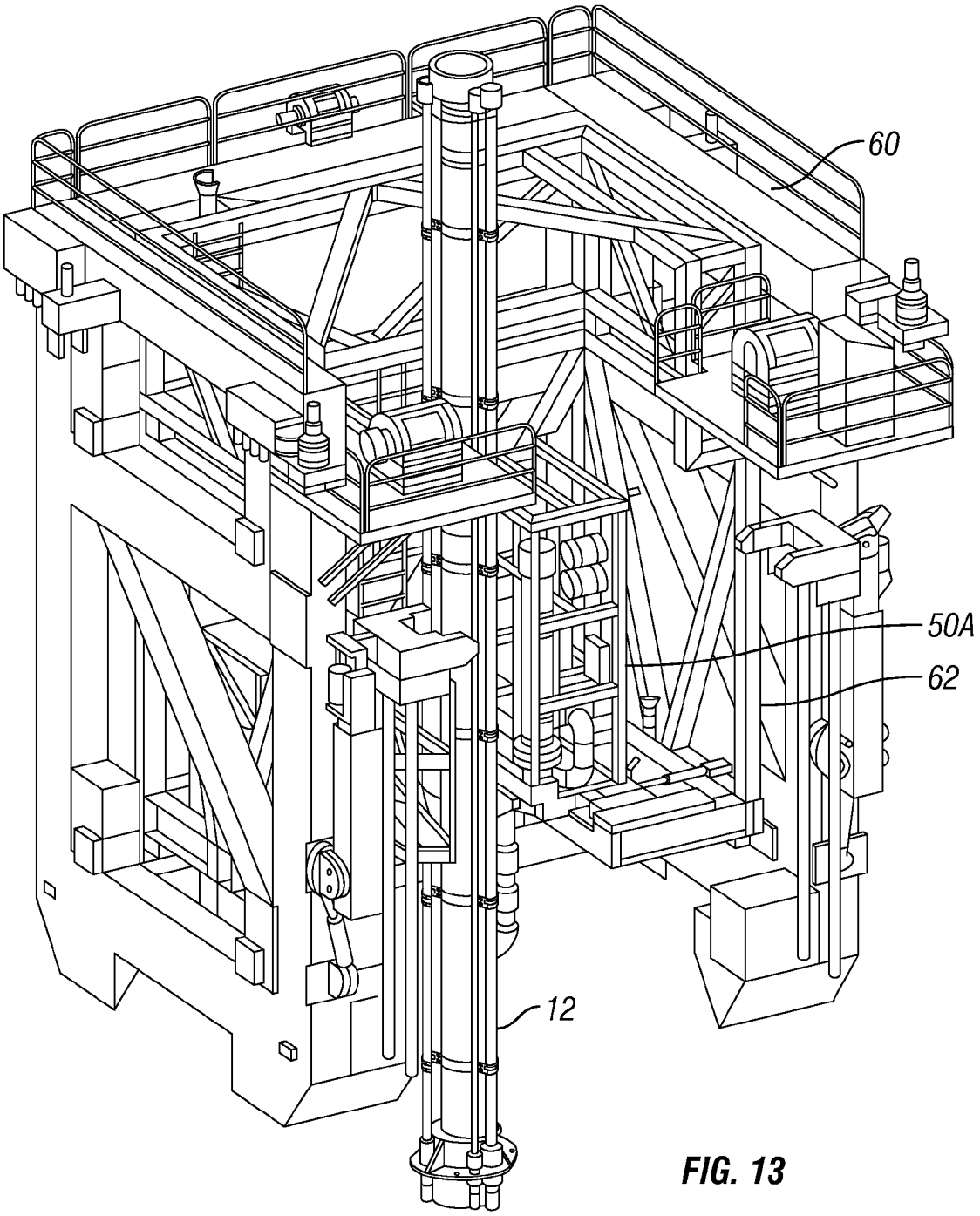
FIGS. 13 and 14 show two different views of a BOP cart (trolley) and an insert therefor to enable using the BOP cart to move one embodiment of a pump module.
Figure 14:
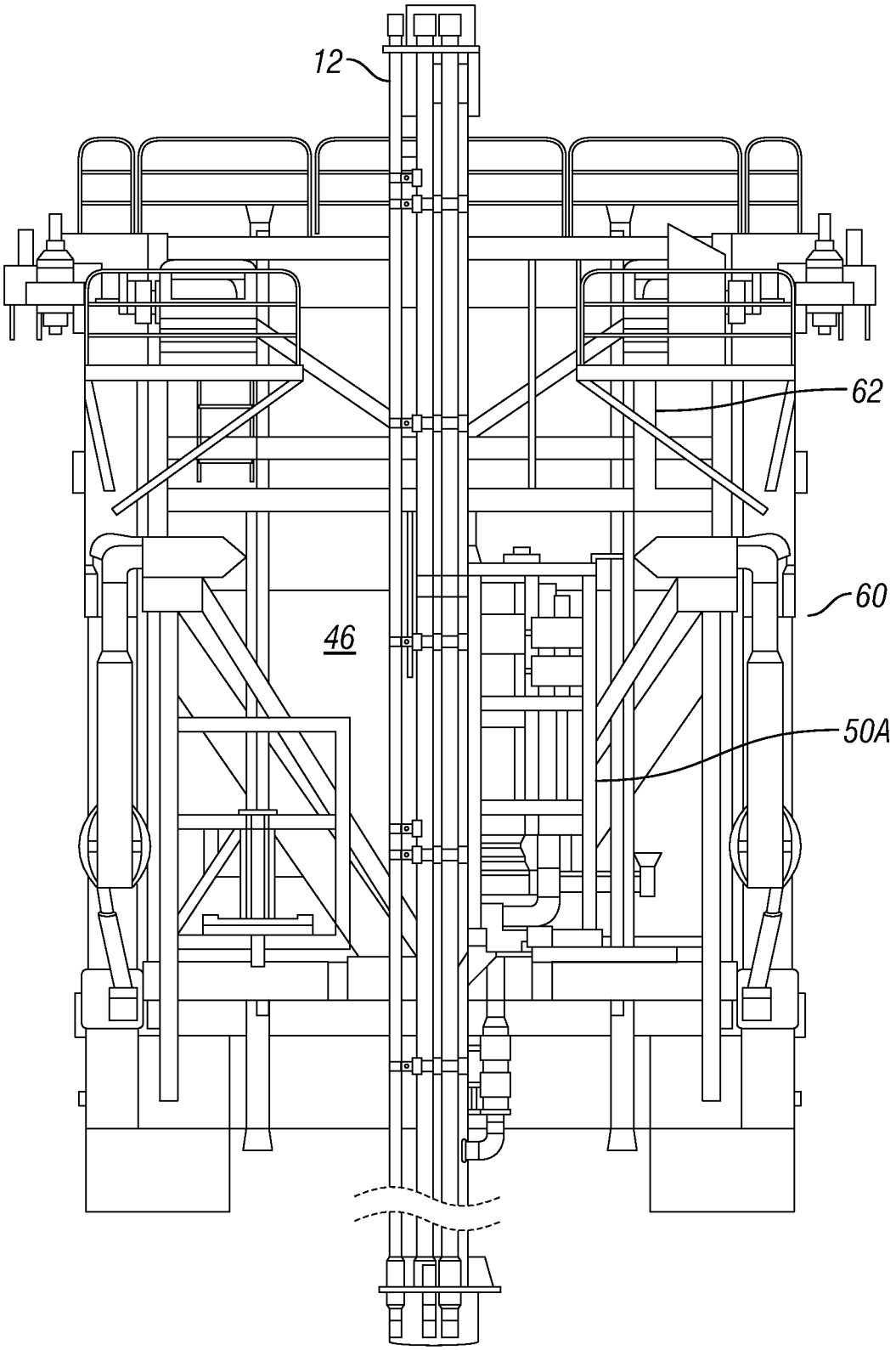

FIGS. 13 and 14 show two views of a BOP cart or trolley 60 typically used just below the platform (4 in FIG. 1) of the drilling unit (1 in FIG. 1) to assemble a blowout preventer ("BOP"—not shown) to the bottom end of a lower marine riser package (not shown) during assembly of the riser 12. The cart 60 may include an insert 62 having dimensions selected to fit within or attach to the cart 60 and retain the frame (51 in FIGS. 4 and 5) of the pump module 50A within or on the cart 60. During assembly of the riser 12 the specific riser segment 46 as explained above is coupled into the riser 12. The riser 12 may be lowered by the drilling unit (1 in FIG. 1) until the specific riser segment 46 is below the platform (4 in FIG. 1) and is at the same elevation on the drilling unit as the BOP cart 60. The BOP cart 60 may be moved laterally until the frame 51 of the pump module 50A is in contact with the specific riser segment or joint 46 as explained above. Mechanical and hydraulic connections to the pump module may be made as explained above, and the riser 12 assembly may then continue as is ordinarily performed.

In some examples, the pipe 48B, valves 48E and spool piece 48D may be omitted. The riser segment 46 may include an opening (not shown) in the wall thereof that mates to a corresponding feature hydraulically connected to the fluid intake of the pump(s) when the pump module (e.g., 40 in FIG. 2, 50 in FIG. 4 or 50A in FIG. 5) is coupled to the riser segment 46. Such opening and pump module feature form a pressure tight seal when the pump module (50 or 50A in FIG. 4 or 5) is assembled to the riser segment 46.

It will also be appreciated by those skilled in the art that any of the foregoing embodiments of a pump module may be disconnected from the riser (12 in FIG. 1) and retrieved to the drilling unit (1 in FIG. 1) in the event of component malfunction. Such operation may be performed with the riser (12 in FIG. 1) fully assembled from the drilling unit to the wellhead (not shown) of the wellbore, typically proximate the water bottom. The pump module may be removed from the riser, for example by a remotely operated vehicle (ROV) and lifted by a winch to the drilling unit for repair or replacement. During such retrieval operation, the wellbore operator may or may not remove the drill string from the wellbore, but the wellbore operator may close one or more of the inflatable annular elements or "rams" on the BOP (not shown) for safety reasons, e.g., to prevent wellbore pressure from escaping through the opening in the riser segment.

Figure 15:
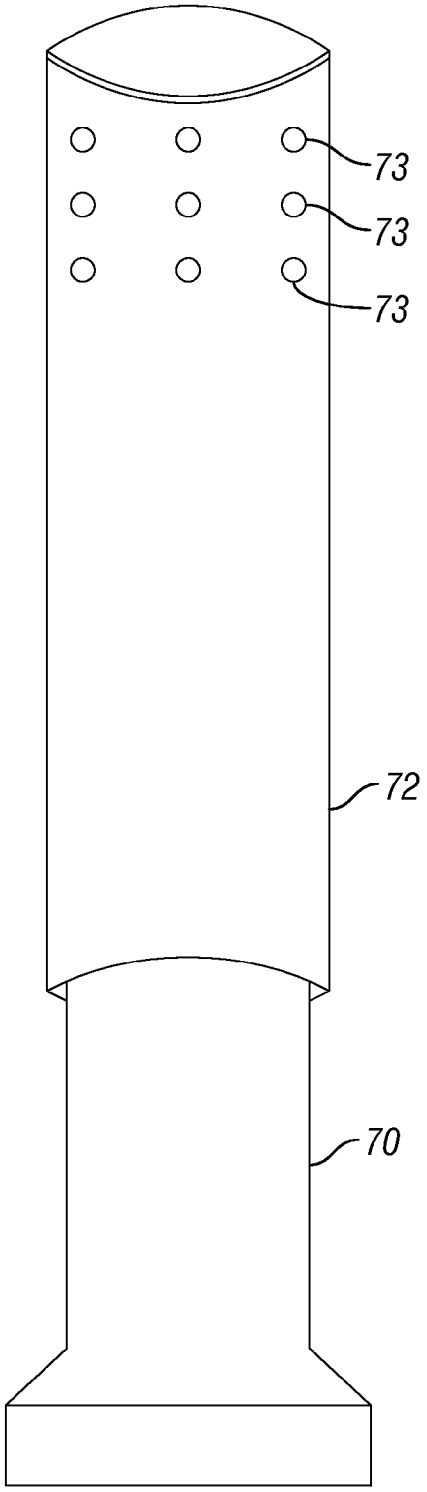
FIGS. 15 and 16 show a "soft landing" structure to enable the pupm to make wet connections to the structure.
Figure 16:
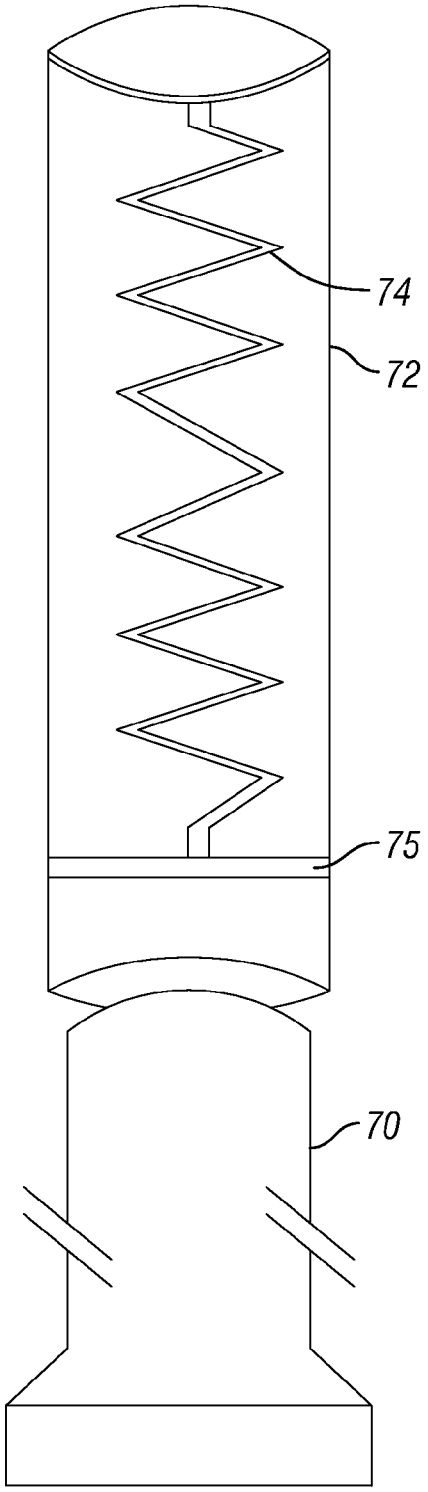

In another example, and referring to FIGS. 15 and 16, one or more "soft landing" elements may be affixed to the docking structure (48C in FIG. 7) or to the upper landing structure (54 in FIG. 12). The soft landing structure(s) may include one or more guide posts 70 affixed to either the docking structure or the upper landing structure. A cylinder 72 having ports 73 in an upper end, and a spring 74 and piston 75 coupled to the spring 74 may be affixed to the pump structure. Such soft landing structures may slow or cushion the rate of engagement of the pump structure to the docking structure rt upper landing structure, thereby reducing the possibility of damage and enabling wet coupling of the pump and lines.

A pump module and corresponding mating riser segment (joint) according to the various aspects of the invention may make assembly of a subsea pump to a fluid return system more efficient, and may reduce the possibility of collapse of the intake pipe to the subsea pump as a result of differential pressure.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A pump module for a drilling riser comprising:

at least one pump mounted to a frame to form the pump module, the pump module including features to couple the pump module to a riser segment; and a fluid inlet affixed to the pump module, the fluid inlet in fluid communication with an intake of the at least one pump, the fluid inlet having features to make a fluid tight hydraulic connection to a fluid outlet of the riser segment when the frame is coupled thereto;

wherein the riser segment includes the fluid outlet and a docking arrangement, wherein assembly of the pump module to the docking arrangement comprises insertion of retention pins in mating openings in the docking arrangement and insertion of the fluid inlet in an opening in the docking arrangement coupled to the fluid outlet.

2. The pump module of claim 1 wherein the docking arrangement is affixed to the drilling riser before the drilling riser passes through a rotary table of a drilling rig.

3. The pump module of claim 1 further comprising a fluid return line coupled to an outlet of the at least one pump and extending to a platform of a drilling unit on a surface of a body of water.

4. The pump module of claim 1 wherein the frame comprises an open box mounted to one side of the riser.

5. The pump module of claim 1 wherein the frame is oriented generally transverse to a longitudinal direction of the drilling riser, the frame comprising a generally semicircular opening to receive the riser segment therein, the frame having the at least one pump and related components disposed on a surface thereof such that weight of the module is distributed about the frame.

6. The pump module of claim 1 wherein an outlet of the at least one pump is connected to an auxiliary line forming part of certain segments of the riser.

7. The pump module of claim 1 further comprising at least one soft landing structure configured to slow a rate of engagement of the frame with the riser segment.

8. A method for assembling a pump to a drilling riser, comprising:

mounting at least one pump to a frame to form a pump module;

affixing a fluid inlet to the pump module such that the fluid inlet is in fluid communication with an intake of the at least one pump;

assembling a riser segment during assembly thereof, the riser segment having a fluid outlet and a docking arrangement for the pump module therein;

lowering the riser segment below a platform of a drilling unit; and connecting the pump module to the riser segment, wherein the connecting comprises inserting retention pins in mating openings in the docking arrangement and inserting the fluid inlet in an opening in the docking arrangement coupled to the fluid outlet.

9. The method of claim 8 further comprising disconnecting the pump module from the riser when the riser is fully assembled from the drilling unit to a wellhead disposed on the bottom of a body of water.

10. The method of claim 8 wherein the connecting is performed in a moonpool of a floating drilling unit.

11. The method of claim 8 wherein the connecting is performed below the platform of the drilling unit and above a body of water using a modified blowout preventer cart to move the pump module laterally toward the riser segment.

12. The method of claim 8 wherein the connecting comprises making a fluid tight connection between the fluid inlet and the fluid outlet disposed in the riser segment.

13. The method of claim 8 further comprising connecting an outlet of the at least one pump to at least one auxiliary riser line.

14. The method of claim 8 further comprising cushioning an approach of the pump module to the riser using at least one soft landing element.

* * * * *